US006261127B1

(12) United States Patent
Miskin et al.

(10) Patent No.: US 6,261,127 B1
(45) Date of Patent: Jul. 17, 2001

(54) HIGH SPEED, SHIELDED CABLE ASSEMBLY

(75) Inventors: Michael Miskin, Little Rock; Munawar Ahmad, Conway; Brian Keith Lloyd, Maumelle, all of AR (US); Michael F. Magajne, Cicero, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/490,385

(22) Filed: Jan. 24, 2000

(51) Int. Cl.[7] ..... H01R 9/03
(52) U.S. Cl. ..... 439/610
(58) Field of Search ..... 439/610, 609, 439/608, 607, 101, 98, 497

(56) References Cited

U.S. PATENT DOCUMENTS

| | | | | |
|---|---|---|---|---|
| 4,867,707 | | 9/1989 | Widdoes | 439/675 |
| 4,875,877 | * | 10/1989 | Fleak et al. | 439/497 |
| 4,984,992 | | 1/1991 | Beamenderfer et al. | 439/108 |
| 5,032,089 | | 7/1991 | Hansell, III | 439/609 |
| 5,176,538 | | 1/1993 | Hansell, III et al. | 439/607 |
| 5,222,898 | | 6/1993 | Fedder et al. | 439/101 |
| 5,588,851 | | 12/1996 | Morlion et al. | 439/108 |
| 5,632,634 | | 5/1997 | Soes | 439/101 |
| 5,961,351 | * | 10/1999 | Wu | 439/610 |

* cited by examiner

*Primary Examiner*—Brian Sircus
*Assistant Examiner*—Thanh-Tam Le
(74) *Attorney, Agent, or Firm*—A. A. Tirva

(57) ABSTRACT

A cable assembly including a cable with at least one connector terminated to an end of the cable. The cable includes at least one pair of signal wires and a grounding member that extends the length of the cable. The signal wires and grounding member are terminated to a connector and specifically terminated to two signal terminals and one ground terminal of the connector. These wires are terminated to tail portions of the terminals which are enclosed in an insulative material that defines a body portion of the connector housing. The ground terminal has two contact portions that extend along the exterior of the connector housing body portion, while the signal terminals have contact portions that extend lengthwise of the connector housing. The signal terminal contact portions are enclosed within an extension of the connector housing and the extension and body portions are themselves enclosed in a metal grounding shell. The grounding shell engages the ground contacts at one end and has two contact arms integrally formed therewith that extend into the interior of the connector housing between the signal terminal contact portions.

5 Claims, 4 Drawing Sheets

HIGH SPEED, SHIELDED CABLE ASSEMBLY

BACKGROUND OF THE INVENTION

The present invention relates generally to cable assemblies used in high speed data transmission, and more particularly to a cable assembly having an improved shielding structure.

In the field of high speed data transmission, the data signals must travel over their associated signal paths with a measure of assurance. This assurance often depends on the impedance of the signal path. While the impedance of electrical cables may be maintained to almost a constant value, drops and rises in impedance often occur at connector points on the cables, for example, where the cable is terminated to a connector and that connector is in turn engaged with another connector. The impedance of a connector that is terminated to a cable may differ significantly from the impedance of the cable as well as the impedance of an opposing connector. Adding shielding to the terminating connector assists in moderating any impedance mismatch, but the effectiveness of shielding such a connector depends largely on the physical structure of the connector. Certain connector structures are made with difficult configurations so that shielding all of the effective portions of the connectors is an expensive task. In other connectors, the structure of the connector prevents the establishment of reliable connections when the desired shielding is added to them.

The present invention is directed to a cable connector construction that overcomes the aforementioned disadvantages.

SUMMARY OF THE INVENTION

Accordingly, it is a general object of the present invention to provide a cable connector in high speed cable assemblies with a reliable connector structure and improved impedance values.

Another object of the present invention is to provide a connector in a cable assembly having a shielded enclosure that provides a shielding member in contact with ground members of the connector throughout the length of the connector, and which mechanically contacts the ground pins of the connector.

Yet another object of the present invention is to provide a shielded cable connector for termination to high speed cable assemblies, the connector having an insulative housing that houses at least two signal contacts and one ground contact, the connector having a shielding member that extends over substantially the entire exterior surface of the connector to thereby enclose the connector housing, the shielding member having at least one tang portion that defines the ground contact of the connector and extending from one end thereof, the shielding member being in contact with a cable ground contact at an opposite end of the connector housing.

Still another object of the present invention is to provide an improved cable connector in high speed applications, the connector having a housing formed from a body portion and an extension portion, the connector housing enclosing a pair of signal contacts which are terminated to associated signal wires of the cable, a shield that encloses the connector housing, the connector housing having at least one ground contact disposed thereon proximate to a rear end of the housing, the ground contact abuttingly engaging the shield, the shield having a tab member extending therefrom and into the interior of the connector housing at the extension portion thereof, the tab member projecting into the connector housing interior in a manner so as to engage a corresponding grounding pin of a pin header, the shield providing beneficial shielding for substantially the entire length of the connector.

It is still yet another object of the present invention to provide an improved cable connector having a connector housing, the connector housing having a body portion that is molded over tail portions of signal and ground terminals of the connector which are terminated to corresponding signal and ground wire leads of a multi-wire cable, the connector housing having an extension portion that extends forward from the body portion and enclosing the contact portions of the connector, while separating the contact portions with an intervening space, the connector having a shield member disposed on an exterior surface of the connector housing, the shield member extending over the connector housing body and extension portions, and wherein the shield member has a grounding contact portion that extends therefrom into the intervening space and aligned with the signal contact portions so as to engage a ground terminal of an opposing connector.

The present invention accomplishes these objects by way of its unique structure. In one principal aspect of the present invention, and as exemplified by the preferred embodiment thereof, a pair of signal leads of two signal wires of the cable are terminated to a pair of corresponding signal terminals of the connector, while the shielding wire of the cable is terminated to a ground terminal. These terminations all occur at tail portions of the signal and ground terminals and these terminations are enclosed within a first housing portion of the connector. This first housing portion is applied to the cable ends and the termination portions of the terminals by insert molding, for example, and this first housing portion provides a strain relief for the cable.

The ground terminal extends transverse to the longitudinal axis of the connector housing to one or more sides of the first housing portion, while the signal terminals extend lengthwise of the connector and extend out from the first housing portion to present their contact portions in opposition to an opposing connector. These signal terminal contact portions are enclosed within a second housing portion that extends from the body portion. the signal terminal contact portions are spaced apart from each other within the connector, as are enclosures of the second housing portion so that an intervening space is defined between both the signal terminal contact portions and their second housing enclosures.

A conductive shielding member is provided that, in effect, electrically encloses the connector by extending over both the first and second housing portions. In this regard, the shielding member extends over the exterior surfaces of the first and second housing portions so that it covers and provides shielding to the cable wire termination points to the signal terminal contact portions. The shielding member takes the form of a hollow, metal sleeve, in the preferred embodiment and it contacts the ground terminal of the connector near the rear of the connector. The leading edge of the shielding member may be slotted to provide one or more legs, or tangs that extend from opposite sides into the intervening space between the two signal terminal contact portions and their enclosures. Ground shielding is therefore effected over the entire length of the connector.

In another aspect of the present invention, the shielding member will include a pair of grounding legs that extend inwardly in order to engage a ground pin of an opposing connector, such as a pin header in order to provide a reliable mechanical grounding contact with the grounding pin. This connection ensures shielding along the entire length of the connector housing. This provides approximately 150 ohms impedance with a variance of about +/−10 ohms at 250 ps rise times.

These, and other objects and advantages will become apparent from the following detailed description when taken in conjunction with the following drawings.

BRIEF DESCRIPTION OF THE DRAWINGS

In the course of the following detailed description reference will be frequently made to the accompanying drawings in which.

DETAILED DESCRIPTION OF THE PREFERRED EMBODIMENTS

Figure 1:
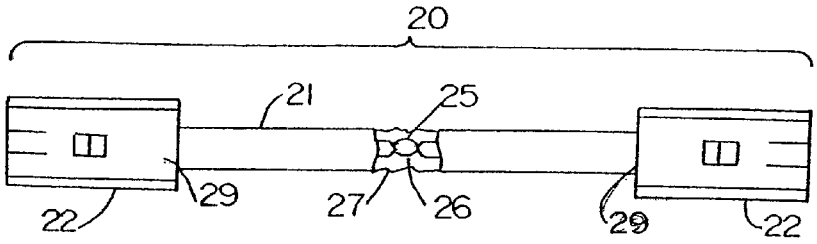
FIG. 1 is a plan view of a cable assembly constructed in accordance with the principles of the present invention.
Figure 8:
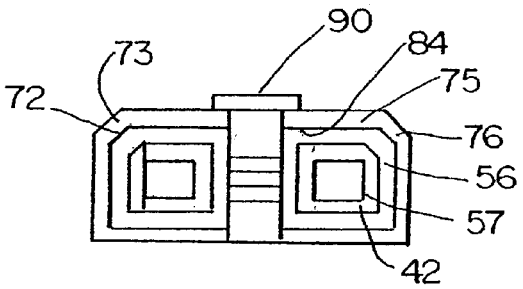
FIG. 8 is an end view of the cable connector of FIG. 1, taken along lines 8—8 thereof.

FIG. 1 illustrates a cable assembly 20 constructed in accordance with the principles of the present invention. This cable assembly 20 can be seen to include an elongated cable 21 with two connectors 22 terminated to opposing ends of the cable 21. The construction of the cable 21 is conventional in that, as shown in FIG. 8, it includes a pair of signal wires 25, 26, and preferably the wire pair includes a differential pair of signal wires that may extend for the length of the cable 21 and which may be twisted together along their length as shown in FIG. 1. The cable signal wires 25, 26 have a ground or drain wire 27 associated therewith, that typically takes the form of either a braided metal shield or a metal type wrapped around the signal wires 25, 26. This assembly is then enclosed within an insulative outer layer 28. Whatever structure the ground wire 27 takes, it extends for substantially the entire length between the two opposing ends 29 of the cable 21.

Figure 6A:
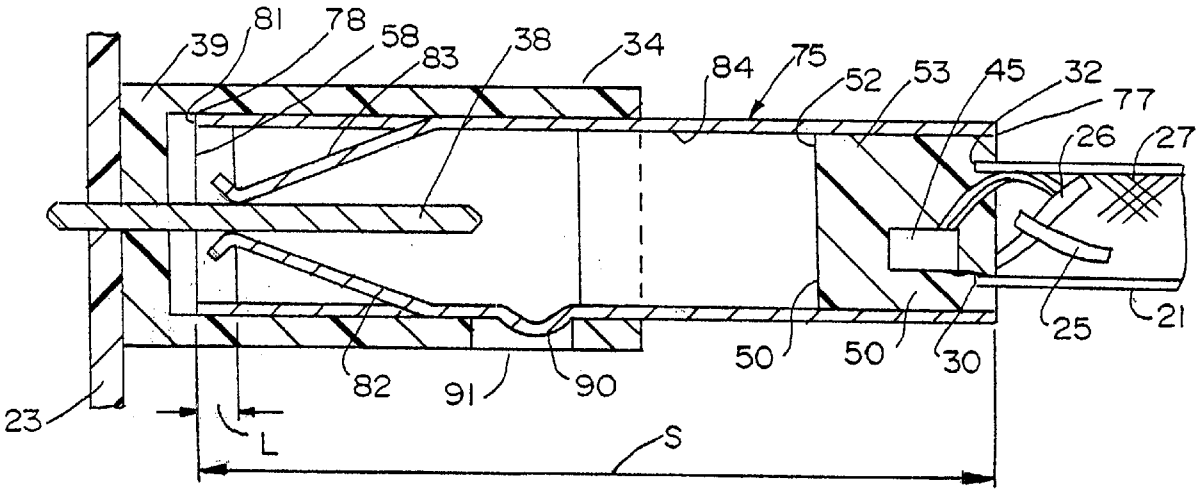
FIG. 6A is a cross-sectional view of a cable connector engaged in place within a pin header taken along a line approximately coincident with a ground pin of the pin header.
Figure 6B:
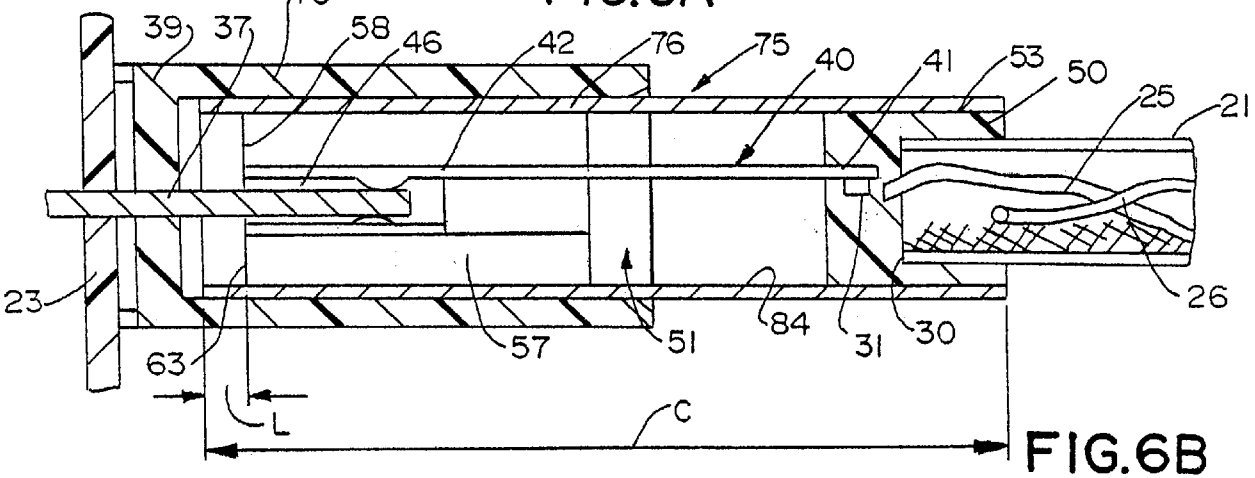
FIG. 6B is a cross-sectional view similar to FIG. 6A, but taken along a line approximately coincident with a signal pin of the pin header.
Figure 7:
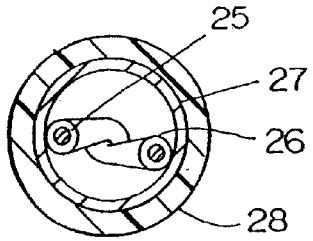
FIG. 7 is a cross-sectional view of the cable of FIG. 1 taken along lines 7—7 thereof.

Turning now to FIGS. 6A&6B, the ends 29 of the cable 21 are trimmed to expose leads of the signal wires 25, 26 and the shielding braid 27 for termination to the connector. The leads 31 of these signal wires 25, 26 are connected to termination tails 41 of the signal terminals 40 of the connector 21, with two such signal contacts being illustrated. Although only a pair of signal terminals 40 are illustrated and the invention is described in terms thereof, it will be understood that the present invention is not limited to connectors and cable assemblies utilizing only two signal terminals. A greater number of terminals may be used and the shielding member may be modified to accommodate grounding with respect to these signal wires.

Figure 3:
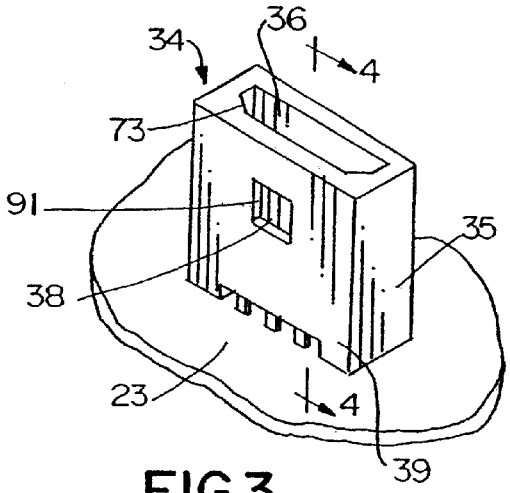
FIG. 3 is a perspective view of a pin header in which the cable assembly of the present invention is used, illustrating the header in place on a circuit board.
Figure 4:
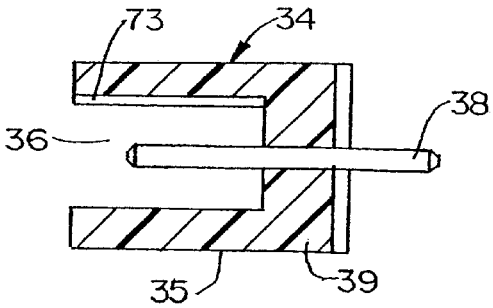
FIG. 4 is a cross-sectional view of the pin header of FIG. 3 taken along lines 4—4 thereof.

The signal terminals 40 may be stamped and formed from a conductive material and may be of a receptacle-type construction, i.e., having a hollow contact portion 42 that is adapted to receive therein a conductive signal pin 37 of an opposing connector. The hollow contact portion 42 illustrated in the drawings is of a box-style terminal construction having four distinct sides to its receptacle. However, it will be understood that other style of receptacles may also be used, such as round, hollow receptacles. In most applications of the present invention, the opposing connector will be a pin header 34. Such a pin header 34 is illustrated best in FIGS. 5&6, wherein it can be seen that the pin header 34 includes an insulative body portion 35 with a hollow interior portion that defines a receptacle 36 that is adapted to receive the connectors 22 of the present invention. The pin header 34 further includes a plurality of conductive signal pins 37 and at least one grounding pin 38 disposed in an array within the header receptacle 36. These pins 37, 38 extend through a base portion 39 of the header 34 that is mounted on a circuit board 23 (FIG. 3.) and they may extend through associated mounting openings or holes formed therein.

The terminals 40 have a preselected length and may be seen to include termination portions 41, in the form of tails to which exposed leads 31 of the signal wires 25, 26 of the cable are attached. This attachment may be effected by any conventional means, such as soldering or welding. The grounding wire 27 of the cable 21 also has a lead 32 prepared by unbraiding the individual wires that make up the shielding wire 27. This lead 32 is likewise attached to a termination portion, or tail 45. The grounding terminal 43 of the connector may take the form of a grounding strap 47, having one or more contact portions 44 extending away at an angle from the tail 45 to an exterior location on the connector body 50.

Figure 9A:
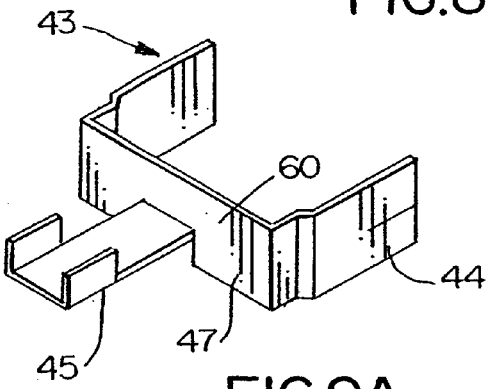
FIG. 9A is a perspective view of a ground terminal used in the connectors of the present invention; and, FIG. 9B is a perspective view of a signal terminal used in the connectors of the present invention.
Figure 9B:
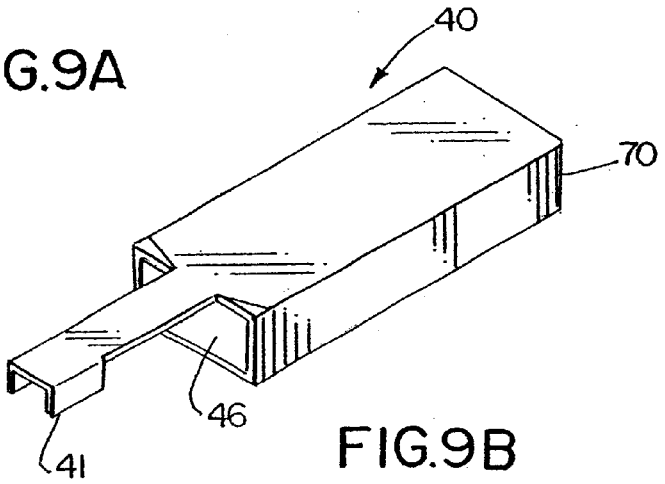

As shown in FIG. 9A, the ground terminal 43 includes a conductive strap portion 47 that forms part of the body, or base 60, of the ground terminal 43. This base 60 has two contact portions 44 that extend or diverge outwardly from the point where the tail portion 45 of the ground terminal 43 meets the base 60. These two contact portions 44 are dimensioned so as to extend along the outer surface 53 of the connector body portion 50. As so presented, the contact portions 44 extend along the body portion 50 as illustrated best in FIG. 5 in a manner where they are easily contacted by the shield 75 of the connector 22.

Figure 2:
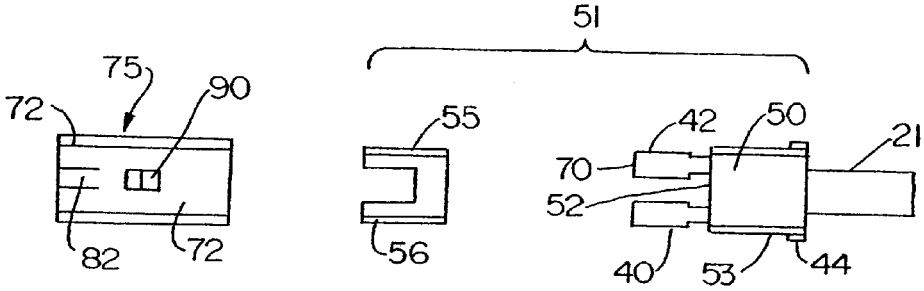
FIG. 2 is an exploded plan view of the connector end of the cable assembly of FIG. 1.
Figure 5:
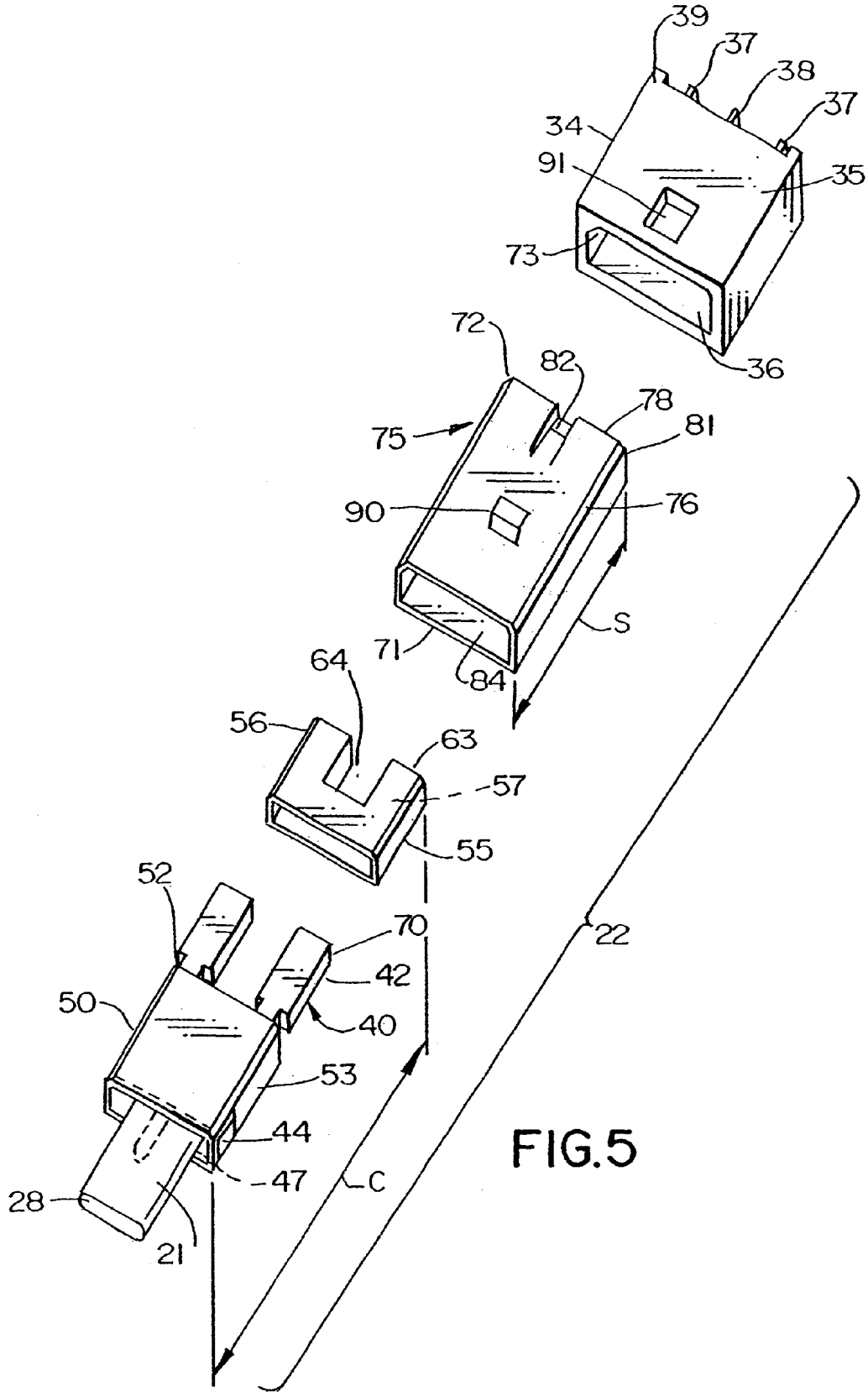
FIG. 5 is an exploded perspective view of the cable connector used in the cable assembly of FIG. 1, illustrated in alignment with a pin header.

Turning now to FIGS. 2&5, the connector 51 can be seen to be cooperatively formed from two components. One such assembly component is the connector body portion 50 that is formed from an insulative material around the tail portions of the terminals 40, 43 of the connector. In this regard, after the wires 25–27 of the cable are stripped and attached respectively to the signal terminal tail portions 41 and the ground terminal tail portion 45 to form a terminal-cable assembly, the assembly is inserted into a mold and insulative material, such as a plastic or nylon or other dielectric material may then be injected into the mold to mold the connector housing body portion 50 over the terminal tail portions 41&47 and the end 30 of the outer cable insulation covering 28.

This material completely fills the mold and forms the body portion 50, which, due to its location (FIG. 6A) provides strain relief to the cable and the termination ends of the cable wires.

This body portion preferably only encompasses the tail portions of the terminals 41, 45 and does not contact the contact portions 42, 44 of the terminals. This is illustrated best in FIG. 5, where it can be seen that the hollow receptacle portions 46 of the signal terminal contact portions 42 extend outwardly and forwardly from the body portion 50 of the connector 22, while the ground terminal contact portions 44 extend out from the body portion and also forwardly along the body portion exterior surface 53. The leading edge 52 of the body portion 50 defines an abutment surface that mates with, and may be considered in some instances to support an extension portion 55 of the overall connector housing.

This extension portion 55 is illustrated in FIGS. 2&5 and it can be seen to include a pair of hollow members, such as tubes 56 that extend lengthwise of the connector for a preselected distance. These two tubes 56 include a central cavity 57 that communicates with a leading face 63 thereof and which, as explained below, houses a signal terminal contact portion 42. The center cavities 57 communicate with the exterior by way of openings 58 disposed along the face 63 of the extension portion 55 so that the contact portions 43 of the signal terminal 40 may be contacted by opposing, conductive signal pins 37 of an opposing connector 34. In the embodiment illustrated, the hollow tubes 56 are shown as resembling elongated boxes to accommodate the box-style receptacle terminals 40, but it will be understood that other shapes, preferably ones that are similar to the signal terminals 40 may be utilized, such as hollow cylindrical tubes.

These extension tubes 56 substantially encompass the receptacle contact portions 42 of the signal terminals 40 and so insulate them from the exterior shield 75 of the connector. The leading edges 63 of the hollow tubes 56 preferably are aligned with the faces 70 of the signal terminal contact portions 42, as shown best in FIG. 6B. This alignment assists in protecting the signal terminals 40 and insulating them from contact with the outer shield 75. As shown in the drawings, the extension portion 55 may be formed as a separate member from the boy portion 50, but it may also be formed together with the body portion as a single piece, or as an assembly of half portions or the like that are assembled together to form the completed connector housing. The extension portion 55 further includes a slot 64 disposed between the two tubes 56 that defines an intervening space that extends rearwardly between the two tubes 56. This slot 64 extends lengthwise of the connector 22.

In an important aspect of the present invention, the connector 22 is provided with a conductive shield member 75, illustrated in the drawings as a hollow metal shell 76, having an elongated body portion that extends between first and second ends 77, 78 thereof. The shell 76 preferably has a length S that is at least equal to or slightly greater than a corresponding length of the connector housing 51, that is, the length C of the connector body portion 50 and extension portion 55 combined. With this length, the shield 75 substantially encompasses the connector housing and the signal terminals 40 contained therein in order to maintain a more uniform impedance value throughout the length of the connector and reduce any drop in impedance that may occur.

The shield 75 has an interior cavity with an inner conductive surface that opposes and overlies the contact portions 44 of the ground terminal 43. In this manner, when the shell 76 is slipped over the body portion 50, the ground terminal contact portions 44 will slide upon and abut the inner surface 84 of the shell 76, thereby establishing electrical contact between the shell and the grounding member 27 of the cable 21. The shell 76 further encloses the extension portion 55 and the two signal terminals 40 that they enclose in the tube portions 56 thereof. Preferably the leading edge 81 of the shell 76 extends slightly past (or forward in the drawings) the leading faces 63 of the tubes so that the shell 76 will also serve to protect the ends of the receptacle contacts of the signal terminal 40. This is shown by distance L in FIGS. 6A and 6B. In order to provide a ground connection through the length of the connector, the shield 75 is also provided with at least one ground contact 82 disposed at a second end 78 thereof. This ground contact is shown as being integrally formed with the body portion of the shell 76, such by being stamped from the shell 76 and proximate to the leading edge 81 thereof.

As shown best in FIGS. 5&6A, this ground contact 82 depends downwardly into the interior cavity of the shell 76. In this disposition, the ground contact 82 also extends into the extension portion slot 64 and into the intervening space between the two tube members 56 of the extension. A second ground contact 83 may be formed in the shell 76 along an opposite surface thereof, shown as the bottom surface thereof. This second ground contact 83 is preferably also stamped from the leading edge 81 of the shell 76 and is also aligned with the first ground contact 82 in a vertical plane. In this manner, the two ground contacts 82, 83 each have a contact area 85 that oppose each other and which further contact opposite sides of a grounding pin 38 of an opposing connector 34. The contact areas 85 of the two ground contacts 82, 83 may be aligned with the faces 89 of the receptacle contacts 42 or may be offset forwardly as illustrated so that the ground contacts 82, 83 will engage the grounding pin 38 of the opposing connector 34 before the signal terminals 40 do, i.e., "make first", and will also disengage from the grounding pin 38 after the signal terminals have disengaged, i.e., "break last".

Furthermore, the overall configuration of the shell 76 may be specifically configured so as to provide a polarizing means to ensure that the connector 21 may engage an opposing connector 34 in only one fashion. In the embodiment illustrated, this polarizing feature is provided by chamfered edges 72 that mate with chamfered corners 73 of the receptacle of the opposing connector 34. The shell 76 may also be provided with a latching, or engagement member 90 that is stamped out of the shell so that it is raised with respect to the rest of the shell profile. This latching member engages an opening 91 formed in the opposing connector 34.

While the preferred embodiments of the invention have been shown and described, it will be appreciated by those skilled in the art that changes and modifications may be made to these embodiments without departing from the spirit of the invention, the scope of which is defined by the appended claims.

We claim:

1. A cable assembly particularly suitable for high-speed applications, comprising:

an elongated cable having at least two signal wires and a grounding member extending for a length of the cable, said signal wires and grounding member being enclosed within an outer insulative wire covering of said cable, a connector terminated to at least one end of said cable, the connector including an insulative housing and at least two conductive signal terminals, each of the signal terminals including a contact portion and a tail portion, said signal wires being terminated to said signal terminal tail portions, said connector further including a ground terminal having at least one contact portion and a tail portion, the grounding member of said cable being terminated to said ground terminal tail portion, the connector housing including an extension enclosing said signal terminal contact portions, and said connector further including a conductive shield member having first and second ends interconnected by a body portion, the shield member extending over said connector housing such that said ground terminal contact portion conductively contacts said shield member to electrically connect said cable grounding member to said shield member, and said shield member having at least one ground contact portion formed therewith and extending therefrom between portions of said extension, said shield ground contact being formed proximate to said first end of said shield and said ground terminal contact portion contacting said shield proximate to said second end of said shield; and wherein said shield member includes a hollow metal shell with an interior cavity that extends through said shell between said first and second ends thereof, said shell overlying said ground terminal contact portion and having a conductive interior surface that contacts said ground terminal contact portion, said ground contact formed therein proximate to said second end thereof, said ground contact and second ground contact extending into said interior cavity of said shell between portions of said extensions.

2. The cable assembly as set forth in claim 1, wherein said extension includes a body with a pair of hollow passages, each of the passages enclosing a signal terminal contact portion, said hollow passages being spaced apart from each other by an intervening space, and said shield ground contact extending into said intervening space.

3. The cable assembly as set forth in claim 1, wherein said signal terminal contact portions extend for a preselected length and include end portions presented in opposition to signal terminals of an opposing connector, the end portions being spaced rearwardly from said shield second end such that said end portions do not protrude past said shield second ends.

4. The cable assembly as set forth in claim 1, wherein said shield includes a second contact portion formed in opposition to said ground contact.

5. A cable assembly particularly suitable for high-speed applications, comprising:

an elongated cable having at least two signal wires and a grounding member extending for a length of the cable, said signal wires and grounding member being enclosed within an outer insulative wire covering of said cable, a connector terminated to at least one end of said cable, the connector including an insulative housing and at least two conductive signal terminals, each of the signal terminals including a contact portion and a tail portion, said signal wires being terminated to said signal terminal tail portions, said connector further including a ground terminal having at least one contact portion and a tail portion, the grounding member of said cable being terminated to said ground terminal tail portion, the connector housing including an extension enclosing said signal terminal contact portions, and said connector further including a conductive shield member having first and second ends interconnected by a body portion, the shield member extending over said connector housing such that said ground terminal contact portion conductively contacts said shield member to electrically connect said cable grounding member to said shield member, and said shield member having at least one ground contact portion formed therewith and extending therefrom between portions of said extension, said shield ground contact being formed proximate to said first end of said shield and said ground terminal contact portion contacting said shield proximate to said second end of said shield; and wherein said housing extension includes a pair of hollow tubes, each of the tubes extending longitudinally of said connector housing and enclosing a signal terminal contact portion therein, said hollow tubes being spaced apart by an intervening space, and each of said hollow tubes including an opening facing in the same direction as shield second end, and wherein said shield member includes a hollow, metal shell having an interior cavity that extends completely through said shell between said first and second of said shield member, said shell having a conductive interior surface that overlies and contacts said ground terminal contact portion and which also overlies said tubes, said shell further having a ground contact formed therein proximate to said shield member second end thereof, ground contact extending into said interior cavity of said shell and between said tubes.

* * * * *